United States Patent [19]

Koyanagi

[11] Patent Number: 4,896,809

[45] Date of Patent: Jan. 30, 1990

[54] FEED DEVICE

[75] Inventor: Yoshihiro Koyanagi, Ashigarakami, Japan

[73] Assignee: Fuji Photo Film Co., Ltd., Kanagawa, Japan

[21] Appl. No.: 254,056

[22] Filed: Oct. 6, 1988

[30] Foreign Application Priority Data

Oct. 6, 1987 [JP] Japan ..... 62-253211

[51] Int. Cl.[4] ..... B65H 20/00; F16H 7/00

[52] U.S. Cl. ..... 226/188; 474/84

[58] Field of Search ..... 226/188, 181; 474/84, 474/85, 86, 87, 112, 270, 242, 244

[56] References Cited

U.S. PATENT DOCUMENTS 2,920,494 1/1960 Dodwell ..... 474/84
3,572,147 3/1971 Obenshain ..... 474/86
3,955,433 5/1976 Hovekamp ..... 474/87
4,015,038 3/1977 Romanski et al. ..... 474/270 X
4,257,547 3/1981 Hirabayashi ..... 226/188 X
4,662,554 5/1987 Yamazaki et al. ..... 226/170

*Primary Examiner*—Daniel P. Stodola
*Attorney, Agent, or Firm*—Sughrue, Mion, Zinn, Macpeak & Seas

[57] ABSTRACT

A feed device for feeding an image recording medium such as a film has a drive drum and at least one nip roller for gripping and feeding the image recording medium therebetween. At least two speed reducers are operatively coupled between the drive drum and a rotative drive source and comprise respective pairs of pulleys of different diameters and respective belts each trained around one of the pairs of pulleys, and wherein the belt operatively associated with the drive drum is of higher rigidity than at least one other belt.

9 Claims, 2 Drawing Sheets

FEED DEVICE

BACKGROUND OF THE INVENTION

The present invention relates to a feed device, and more particularly to a feed device for feeding an image recording medium such as a film or the like by gripping the same between a drive drum and nip rollers, the drive drum being operatively coupled to a rotative drive source through a plurality of speed reducer means comprising belts and pulleys, the belt which engages the drive roller being of higher rigidity than the ridigity of the other belts, so that the drive drum can accurately be rotated without being affected by external forces.

Image scanning reading and recording systems are widely used in the printing and platemaking industries for reading and electrically processing image information of originals or subjects to produce original film plates with a view to simplifying the entire process and improving the quality of printed images.

The image scanning reading and recording systems are basically constructed of an image reading apparatus, a controller, and an image recording apparatus which may be coupled to or separate from each other. In the image reading apparatus, a reflective subject or a linear image subject is scanned with a light beam, and its image information is detected by a photomultiplier or the like, or ready by a CCD (charge-coupled device) camera, so that the image information of the subject is converted into an electrical signal representing varying intensities of the reflected light from the subject. Then, the photoelectrically converted image information from the image reading apparatus is processed in the controller for signal processing such as gradation correction, edge emphasis, and the like according to platemaking conditions. Thereafter, the processed image signal from the controller is converted in the image recording apparatus into a light signal such as a laser beam signal which is applied to an image recording medium comprising a photosensitive material such as a photographic film for recording a desired image thereon. The image recording medium with the image recorded thereon is developed and will be used as a film plate for printing.

More specifically, the image recording apparatus in the image scanning reading and recording system for applying a laser beam on a film or the like based on the image information of a subject to record the image on the film or the like is constructed and operates as follows:

A magazine with a roll of elongated film stored therein is loaded in the image recording apparatus. Then, the film is gripped by a pair of feed rollers. The feed rollers are rotated to feed the film into an image scanner. In the image scanner, the film is fed in an auxiliary scanning direction by a rotating drive drum and nip rollers that can be rollingly held against the drive drum. At the same time, a laser beam that is modulated by the processed image signal from the controller is applied to the film to scan the same in a main scanning direction, thereby recording the desired image on the film. Thereafter, the film is automatically cut off into a desired length by a cutter in the image recording apparatus, and then delivered into an image developing apparatus, for example, by a film delivery system.

In order to record the desired image accurately on the film, it is necessary to feed the film highly accurately in the auxiliary scanning direction at a relatively low speed. To meet this requirement, a plurality of speed reducer means comprising belts and pulleys are disposed between a rotative drive source such as a motor or the like and the drive drum. When the rotative drive source is energized, the speed of rotation thereof is reduced by the speed reducer means, and the drive drum is rotated at the reduced speed of rotation.

The belts of the speed reducer means are made of a material having relatively low rigidity such as an elastomer like synthetic rubber or the like, or a synthetic resin material. Therefore, if the load on the drive drum fluctuates, such as when the leading end of the film while being gripped by the drive drum and the nip rollers and fed in the auxiliary scanning direction enters between the paired feed rollers, the belts of relatively low rigidity are affected by such a load fluctuation to cause the drive drum to suffer irregular rotational speeds. As a result, the film cannot accurately be fed in the auxiliary scanning direction, and thus the desired image cannot accurately be recorded on the film.

The belts of the speed reducer means may be made of a material of high rigidity such as a metalic material. Since, however, the metallic belts have a high resonant frequency, rotational fluctuations, i.e., high-frequency components of the rotational speed, of the rotative drive source tend to be transmitted through the belts to the drive drum. Consequently, the rotational speed of the drive drum is also liable to vary, and it cannot feed the film accurately in the auxiliary scanning direction at a constant speed.

SUMMARY OF THE INVENTION

It is a primary object of the present invention to provide a feed device for feeding an image recording medium, the feed device including a plurality of speed reducer means comprising belts and pulleys and disposed between a rotative drive source such as a motor and a drive drum, the belt engaging the drive drum being of higher rigidity than the rigidity of the other belts operatively associated with the rotative drive source, so that the drive drum can be rotated accurately at a constant speed through the more rigid belt without being affected by load fluctuations or variations applied to the drive drum, and rotational speed fluctuations are prevented by the less rigid belts from being transmitted from the rotative drive source to the drive drum, for thereby allowing the image recording medium to be fed highly accurately.

Another object of the present invention is to provide a feed device for feeding an image recording medium, comprising: a drive drum having a belt operatively associated therewith and at least one nip roller for gripping and feeding an image recording medium therebetween; a rotative drive source; and at least two speed reducer means operatively coupled between the drive drum and the rotative drive source and comprising respective pairs of pulleys of different diameters and respective belts each trained around one of respective pairs of the pulleys, wherein the belt operatively associated with the drive drum is of higher rigidity than at least one other of the respective belts.

Still another object of the present invention is to provide a feed device for feeding an image recording medium, wherein the belt operatively associated with the drive drum comprises a belt of a metallic material, and at least one other of the respective belts comprises a belt of a synthetic resin material.

Yet another object of the present invention is to provide a feed device for feeding an image recording medium, wherein the belt operatively associated with the drive drum has a larger spring constant than that of at least one other of the respective belts.

Yet still another object of the present invention is to provide a feed device for feeding an image recording medium, wherein the belts are made of the same material, and wherein the belt operatively associated with the drive drum has a larger cross-sectional area than that of at least one other of the respective belts.

A further object of the present invention is to provide a feed device for feeding an image recording medium, wherein the belts are made of the same material, and wherein the belt operatively associated with the drive drum has a shorter effective length than that of at least one other of the respective belts.

A yet further object of the present invention is to provide a feed device for feeding an image recording medium, wherein the pulleys of each of the speed reducer means include a first smaller-diameter pulley and a second largerdiameter pulley, the belt of each of the speed reducer means being trained around the first and second pulleys, the first pulley of one of the at least two speed reducer means and the second pulley of another of at least two speed reducer means being coaxially coupled to each other.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
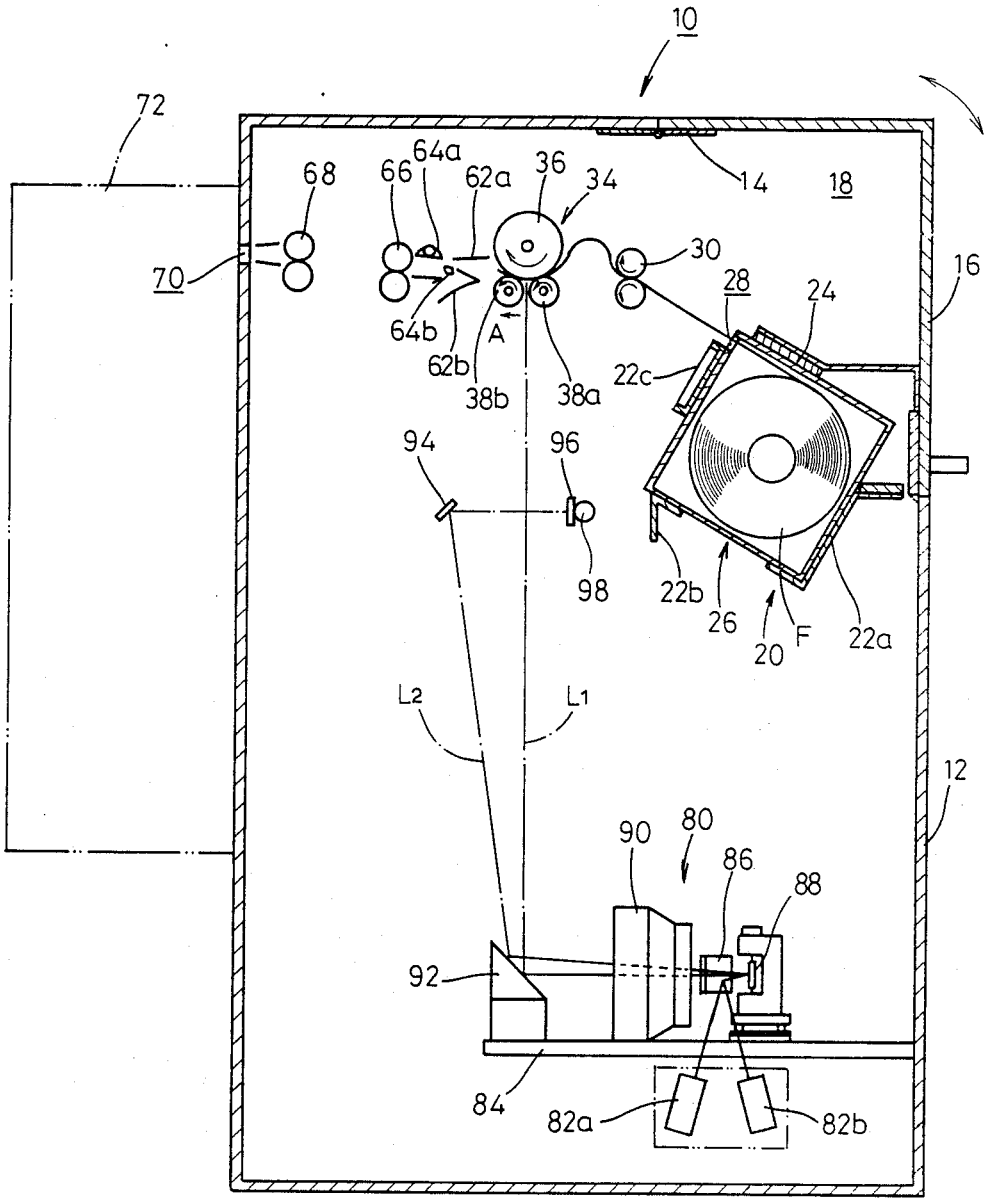
FIG. 1 is a schematic elevational view, partly in cross section, of an image recording apparatus incorporating a feed device according to the present invention.

FIG. 1 schematically shows an image recording apparatus 10 in which a feed device according to the present invention is incorporated. The illustrated image recording apparatus 10 is constructed as being separate from an image reading apparatus and a controller, both not shown. However, it is possible to employ an image scanning reading and recording system incorporating therein such an image recording apparatus 10, an image reading apparatus, and a controller.

The image recording apparatus 10 includes a housing 12 with a bent lid 16 being operably and closably attached to a righthand upper portion thereof by means of a hinge 14. The housing 12 defines therein a chamber 18 storing a magazine loading unit 20 which includes a plurality of receivers **22*a*, 22*b*, 22*c* disposed in the chamber 18 and a presser 24 fixed to the lid 16. By opening the lid 16, a magazine 26 can be stored in or removed from the magazine loading unit 20**.

The magazine 26 stores therein a roll of an elongate unexposed film F having an end led out of a film outlet slot 28 defined in the magazine 26 and gripped by a feed roller pair 30 disposed in the chamber 18.

Figure 2:
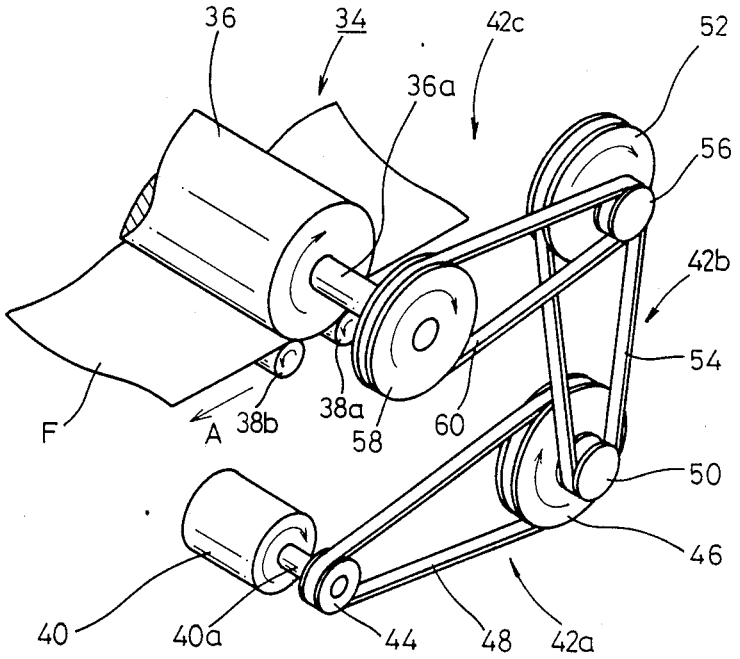
FIG. 2 is a perspective view of the feed device of the present invention.

A feed device or mechanism 14 according to the present invention is disposed in the chamber 18 and spaced a prescribed distance from the feed roller pair 30. The feed device 34 is basically constructed of a large-diameter drive drum 36 which is rotatable about its own axis, and a pair of nip rollers **38*a*, 38*b* which are held in rolling contact with the drive drum 36 under the bias of a resilient member (not shown). As shown in FIG. 2, the drive drum 36 is rotated at a relatively low speed by first, second, and third speed reducers 42*a*, 42*b*, 42*c* operatively coupled to a rotative drive source 40** such as an electric motor.

More specifically, the first speed reducer **42*a* has a first smaller-diameter pulley 44 mounted on a rotatable drive shaft 40*a* extending from the rotative drive source 40, a first belt 48 made of a synthetic resin material and trained around the first smaller-diameter pulley 44, and a second larger-diameter pulley 46 spaced from and larger in diameter than the first smaller-diameter pulley 44, the first belt 48 being also trained around the second pulley 46. The second speed reducer 42*b* includes a third smaller-diameter pulley 50 mounted coaxially on the second pulley 46, a fourth larger-diameter pulley 52 spaced from and larger in diameter than the third pulley 50, and a second belt 54 made of a synthetic resin material and trained around the third and fourth pulleys 50, 52. The third speed reducer 42*c* comprises a fifth smaller-diameter pulley 56 mounted coaxially on the fourth pulley 52, and a sixth larger-diameter pulley 58 mounted on a rotatable shaft 36*a* of the drive drum 36, the sixth pulley 58 being spaced from and larger in diameter than the fifth pulley 56. The third speed reducer 42*c* further comprises a third belt 60 trained around the fifth and sixth pulleys 56, 58 and made of a material of higher rigidity than the first and second belts 48, 54**, such as a metallic material.

As shown in FIG. 1, a pair of guide plates **62*a*, 62*b* are disposed on a path along which the film F is fed from the feed device 34. A pair of cutter blades 64*a*, 64*b* are disposed near the guide plates 62*a*, 62*b* for cutting off the film F into a prescribed length. The film F fed along the path through the guide plates 62*a*, 62*b* and cut off by the cutter blades 64*a*, 64*b* is delivered through successive feed roller pairs 66, 68, and then from a film discharge slot 70 defined in the housing 12 into an image developing apparatus 72 associated with the image recording apparatus 10**.

A light beam scanner 80 is disposed in the housing 12 below the feed device 34 for recording image information on the film F. The light beam scanner 80 includes a pair of laser beam sources **82*a*, 82*b* for emitting a recording laser beam $L_1$ and a synchronizing laser beam $L_2$, respectively, the laser beam sources 82*a*, 82*b* being mounted on a support plate 84 fixed to the housing 12 (In FIG. 1, the laser beam sources 82*a*, 82*b* are shown as being disposed below the support plate 84 for clarity). A mirror 86, a beam deflector 88 such as a galvanometer mirror, a scanning lens 90 such as an f$\theta$ lens, and a mirror 92 are also mounted on the support plate 84 for directing the laser beam $L_1$ emitted from the laser beam source 82*a* to scan th film F. The synchronizing laser beam $L_2$ emitted from the laser beam source 82*b* is guided by the mirror 86, the galvanometer mirror 88, the scanning lens 90, and the mirror 92 toward a mirror 94. The synchronizing laser beam $L_2$ reflected by the mirror 94 is applied to a reference grating plate 96 having a transmissive grid, with a light collection bar 98 disposed near and behind the reference grating plate 96. Light detectors (not shown) are mounted respectively on the opposite ends of the light collecting bar 98 for detecting the synchronizing laser beam $L_2$ that has passed through the reference grating plate 96 and the light collecting bar 98** as pulsed signals.

The image recording apparatus incorporating the feed device of the present invention is basically constructed as described above. Now, operation and advantages of the image recording apparatus will be described below.

The lid 16 is opened about the hinge 14, and the magazine 26 is stored in the magazine loading unit 20. The end of the elongated film F stored as a roll in the magazine 26 is pulled out of the outlet slot 28 and gripped by the feed roller pair 30.

Then, the lid 16 is closed, and the feed roller pair 30 is rotated in the direction of the arrows. While allowing the film F to slack between the feed device 34 and the feed roller pair 30, the feed device 34 and the feed roller pair 30 are rotated synchronously.

More specifically, as illustrated in FIG. 2, the rotative drive source 40 is energized to rotate the drive shaft 40*a* about its own axis in the direction of the arrow. The first pulley 44 mounted on the drive shaft 40*a* is rotated to cause the first belt 48 to rotate the second pulley 46 in the direction of the arrow at a relatively low speed. The third pulley 50 fixed to the second pulley 46 is also rotated to enable the second belt 54 to rotate the fourth pulley 52 at a relatively low speed. The fifth pulley 56 coupled to the fourth pulley 52 is also rotated, and the sixth pulley 58 is rotated by the third belt 60 trained around the fifth pulley 56. As a result, the drive drum 36 is rotated about its own axis at a considerably low speed by the shaft 36*a* coupled to the sixth pulley 58. The film F which is gripped between the drive drum 36 and the nip rollers 38*a*, 38*b* thus fed in an auxiliary scanning direction indicated by the arrow A at a certain speed.

At the same time, the light beam scanner 80 is energized. More specifically, the laser beam sources 82*a*, 82*b* are energized to emit laser beams $L_1$, $L_2$, respectively, which are reflected by the galvanometer mirror 88 while the galvanometer mirror 88 is angularly moved back and forth to deflect the laser beams $L_1$, $L_2$. The laser beam $L_1$ is guided by the scanning lens 90 and the mirror 92 to irradiate the film F between the nip rollers 38*a*, 38*b*. The other laser beam $L_2$, after being reflected by the mirror 94, is applied through the reference grating plate 96 to the light collecting bar 98, and detected as pulsed signals by the nonillustrated light detectors. The pulsed signals are then processed by multiplying their frequency to produce a synchronizing signal.

At the same time that the laser beam $L_1$ is applied to the film F in the main scanning direction, the film F is fed in the auxiliary scanning direction by the feed device 34, so that the laser beam $L_1$ scans the film F twodimensionally to record a desired image thereon.

The film F is further guided by the guide plates 62*a*, 62*b* in the direction of the arrow A and then cut off into a suitable film length by the cutter blades 64*a*, 64*b*. The cut film length with the image recorded thereon is then delivered by the roller pairs 66, 68 through the discharge slot 70 into the image developing apparatus 72. In the image developing apparatus 72, the recorded image on the film length is developed into a visible image, and the film length will be used as a film plate for various applications.

In the illustrated embodiment, even when the drive drum 36 is subjected to load variations or fluctuations under extremely applied forces, the drive drum 36 can be rotated at a constant speed, and it is also possible to prevent rotational speed fluctuations of the rotative drive source 40 from adversely affecting the drive drum 36.

The inventor conducted an experiment on a highly rigid metallic belt (such as the third belt 60) which was trained around the sixth pulley 58 and also on a less rigid synthetic resin belt (such as the first and second belts 48, 54) which was trained around the sixth pulley 58, in order to find out which belt can better withstand load fluctuations on the drive drum 36. In the experiment, the fifth pulley 56 around which each belt was also trained was fixed against rotation. With a film or other object to be fed being gripped between the drive drum 36 and the nip rollers 38*a*, 38*b*, a force required to move the object a distance of 1 μm was measured. The results are given in the following table:

TABLE

| | Synthetic resin belt | Metallic belt |
|---|---|---|
| Young's modulus (E) | 520 kg/mm$^2$ | 18,000 kg/mm$^2$ |
| Spring constant (K) | 4.3 kg/mm | 148.8 kg/mm |
| Force required to move the object by 1 μm | 15 g | 519 g |

As is apparent from the table, when the synthetic resin belt was used, the object was moved 1 μm by applying a force of 15 g, whereas when the metallic belt was used, a force of 519 g was required to move the object 1 μm. Therefore, it can be seen that when the third metallic belt 60 of high rigidity (i.e., high spring constant) is trained around the sixth pulley 58 coupled to the drive drum 36, it can well withstand load fluctuations of the drive drum 36, and hence can rotate the drive drum 36 accurately at a prescribed speed.

The first synthetic resin belt 48 of relatively low rigidity is trained around the first pulley 44 mounted on the drive shaft 40*a* of the rotative source 40. Therefore, since the first belt 48 has a low resonant frequency, rotational speed variations or fluctuations of the rotative drive source 40, i.e., high-frequency components of the rotational speed thereof, are not transmitted over, but are absorbed by, the first belt 48. The drive drum 36 is thus protected from rotational speed fluctuations which would otherwise result from rotational speed fluctuations from the rotative drive source 40. Consequently, the drive drum 36 can also be rotated highly accurately at a constant speed.

By thus forming the third belt 60 associated with the drive drum 36 of a highly rigid metallic material and forming the first belt 48 associated with the rotative drive source 40 of a less rigid synthetic resin material, i.e., by selecting a larger spring constant for the third belt 60 than for the first belt 48, the drive drum 36 can be rotated highly accurately at a desired constant speed without being adversely affected by external forces.

The spring constant (K) can generally be given by:

$$K = \frac{EA}{l}$$

where E:

Young's modulus,

A: cross-sectional area, l: effective length.

Therefore, by forming the belts 48, 54, 60 of the same material, and either selecting a larger cross-sectional area for the third belt 60 than for the other belts 48, 54, or making the effective length of the third belt 60 shorter than the effective length of the belts 48, 54, it is possible to make the spring constant of the third belt 60 virtually greater than the spring constant of the other belts 48, 54. It is not necessary to restrict the material of the third belt 60 to a metallic material, but the third belt 60 may be made of a material with its Young's modulus larger than that of the material of the other belts 48, 54, thereby giving a larger spring constant to the third belt 60 than to the first and second belts 48, 54.

While in the preferred embodiment the third belt 60 is made of a metallic material and the first and second belts are made of a synthetic resin material, the first belt 48 may also be a metallic belt. With this modification, rotational speed fluctuations of the rotative drive source 40 are prevented by the second speed reducer **42*b* including the second belt 54 from being transferred to the drive drum 36**, which is thus allowed to rotate highly accurately at a constant speed.

With the present invention, as described above, the speed reducers comprising belts and pulleys are disposed between and operatively coupled to the drive drum for feeding the image recording medium and the rotative drive source, and the belt operatively associated with the drive drum is of higher rigidity than the belt or belts operatively associated with the rotative drive source. Therefore, even when the drive drum undergoes load variations or fluctuations, such as when the image recording medium being fed in the auxiliary scanning direction by the drive drum and the nip rollers enters between paired feed rollers, the drive drum is prevented by the highly rigid belt from being adversely affected by such load fluctuations, and is allowed to rotate accurately at a constant speed. Rotational speed fluctuations of the rotative drive source are absorbed by the less rigid belt or belts and thus will not be transmitted to the drive drum. As a result, the drive drum can be rotated accurately at all times for feeding the image recording medium with high accuracy.

Although a certain preferred embodiment has been shown and described, it should be understood that many changes and modifications may be made therein without departing from the scope of the appended claims.

What is claimed is:

1. A feed device for feeding an image recording medium, comprising:

a drive drum having a belt operatively engaged therewith and at least one nip roller for gripping and feeding an image recording medium therebetween;

a rotative drive source; and at least two speed reducer means operatively coupled between said drive drum and said rotative drive source, each comprising respective pairs of pulleys of different diameters and respective belts each trained around one of said respective pairs of pulleys, wherein said belt operatively engaged with said drive drum is one of said respective belts and is of higher rigidity than at least one other of said respective belts.

2. A feed device according to claim 1, wherein said belt operatively engaged with said drive drum comprises a belt of a metallic material, and at least one other of said respective belts comprises a belt of a synthetic resin material.

3. A feed device according to claim 2, wherein all of said belts other than said belt operatively engaged with said drive drum are made of a synthetic resin material.

4. A feed device according to claim 2, further comprising a third speed reducer means, wherein one of said respective belts is operatively engaged with said rotative drive source and is made of a metallic material and said belt comprised of a synthetic resin material is located between said belt operatively engaged with said drive drum and said belt operatively engaged with said rotative driven source.

5. A feed device according to claim 1, wherein said belt operatively engaged with said drive drum has a larger spring constant than that of at least one other of said respective belts.

6. A feed device according to claim 5, wherein said belts are made of the same material, and wherein said belt operatively engaged with said drive drum has a larger cross-sectional area than that of at least one other of said respective belts.

7. A feed device according to claim 5, wherein said belts are made of the same material, and wherein said belt operatively engaged with said drive drum has a shorter effective length than that of at least one other of said respective belts.

8. A feed device according to claim 5, wherein said belt operatively engaged with said drive drum is made of a material having a larger Young's modulus than that of at least one other of said respective belts.

9. A feed device according to claim 1, wherein the pulleys of each of said speed reducer means include a first smaller-diameter pulley and a second larger-diameter pulley, the belt of each of said speed reducer means being trained around said first and second pulleys, said first pulley of one of said at least two speed reducer means and said second pulley of anoter of said at least two speed reducer means being coaxially coupled to each other.

* * * * *